United States Patent [19]

Murphy

[11] 4,258,917

[45] Mar. 31, 1981

[54] ROTOCASTING PROCESS FOR PRODUCING RUBBERY REINFORCED ARTICLES

[75] Inventor: Walter T. Murphy, Cuyahoga Falls, Ohio

[73] Assignee: The B. F. Goodrich Company, Akron, Ohio

[21] Appl. No.: 99,292

[22] Filed: Dec. 3, 1979

[51] Int. Cl.[3] ..... A63B 41/00; B28C 5/04

[52] U.S. Cl. ..... 273/65 ED; 29/157.1 R; 264/257; 264/258; 264/310; 264/311; 273/58 BA; 273/58 J; 428/35

[58] Field of Search ..... 264/257, 258, 310, 311; 273/58 BA, 58 J, 65 ED; 428/35; 29/157.1 R

[56] References Cited

U.S. PATENT DOCUMENTS

| | | | |
|---|---|---|---|
| 3,095,261 | 6/1963 | Meyer | 273/58 BA |
| 3,607,500 | 9/1971 | Field | 264/257 |
| 4,119,592 | 10/1978 | Murphy | 264/311 |
| 4,154,789 | 5/1979 | Delacoste | 264/310 |
| 4,169,594 | 10/1979 | Crane | 264/311 |
| 4,183,883 | 1/1980 | Blair | 264/257 |
| 4,187,134 | 2/1980 | Svub | 273/58 J |

FOREIGN PATENT DOCUMENTS

| | | | |
|---|---|---|---|
| 51-61568 | 5/1976 | Japan | 264/310 |

*Primary Examiner*—James H. Derrington
*Attorney, Agent, or Firm*—Roy P. Wymbs

[57] ABSTRACT

A process is provided for making reinforced rubbery sport and play balls by rotational casting, in a mold lined with a nonwoven fabric, a liquid polymer composition containing an epoxy resin, a liquid carboxyl-terminated polymer, an amine, a dihydric compound, and a plasticizer. The sections of nonwoven fabric in the mold are preshrunk and sealed together by means of an amine-terminated liquid polymer. The resultant sport and play balls have good dimensional stability and the desired flex and tear properties.

21 Claims, No Drawings

ROTOCASTING PROCESS FOR PRODUCING RUBBERY REINFORCED ARTICLES

BACKGROUND OF THE INVENTION

Sport balls, such as basketballs, and the like, contain hollow rubber bladders, the production of which involves a rather complex process. For example, rubber compounds, such as butyl rubber, are compounded on a rubber mill or a Banbury mixer and the compound is calendered to the desired thickness in sheet form. Quarter sections are then die cut from the rubber sheet and pieced together by hand and end patches. A valve is then inserted and adhered to the construction which is then heat cured to produce an inflatable bladder. Because of the adhesive splices, imperfect seals and poor weight balance, high numbers of defective bladders and excessive waste material often result.

In order to overcome these difficulties, the industry now employs a rotocasting process, involving a thermoplastic material such as polyethylene or a vinyl plastisol. However, these materials do not have the resiliency and air retention of rubber and have not proved suitable for use in basketballs, and the like. It has been proposed to employ in the rotocasting process liquid carboxy-terminated poly(butadieneacrylonitrile)polymers, as described in U.S. Pat. No. 4,119,592, issued Oct. 10, 1978. These polymers proved to be very effective in producing rubber bladders for sport balls.

In all of the processes used heretofore, it has been necessary to build dimensional stability into the product. Without some means of dimensional reinforcement, inflated elastomeric sport balls gradually grow in size and become unsuitable for proper use. Presently, the industry employs a filament winding process using nylon filaments, for example, to reinforce the bladder component of sport balls. However, the filament winding process is quite complicated and usually requires computerized controls in order to achieve uniformity of distribution. Further, the winding operation is a separate step following the production of the bladder component which not only complicates the process of producing rubbery bladders but also increases the cost of producing sport balls. Accordingly, there is a need in the art to simplify the process of producing rubbery bladders for pneumatic sport balls or playballs.

SUMMARY OF THE INVENTION

It has been found that when a nonwoven fabric reinforcement is included in the rotational casting step, the need for subsequent filament winding of the bladder for dimensional stability is eliminated. The process of the present invention comprises forming two preformed and preshrunk half shells of nonwoven fabric which are then placed in the upper and lower halves of a rotomold so as to line the entire inner surfaces thereof. The nonwoven fabric is cut so as to cover the flange area between the two halves of the mold or so that one half shell overlaps the other. Then inserting a circular strip of film, formed from an amine-terminated liquid polymer, in between the layers of fabric in the flange area or in between the overlapping portions of the fabric and adding to the lower half of the mold a liquid carboxyl-containing polymer compound, closing the mold tightly and rotocasting the materials to produce a dimensionally stable bladder or ball at a temperature sufficient to seal the half shells of nonwoven fabric together and impregnate and encapsulate the same with the liquid carboxyl-containing polymer compound.

DETAILED DESCRIPTION

One of the important aspects of the present invention is the nonwoven fabric that is employed. It may be one formed from natural staple fibers, such as cotton, wool, flax, and the like, or one formed from synthetic fibers or artificial fibers, such as rayon or regenerated cellulose fibers, nylon which may be formed from polyhexamethylene adipamide, polycaprolactam, etc., acrylic fibers such as those formed from polyacrylonitrile, copolymers of acrylonitrile with other monomers, such as vinyl acetate, methyl acrylate, methyl vinyl pyridine, and the like, polyester fibers such as those formed from polyethylene terephthalate, and the like, polyolefin fibers such as those formed from polyethylene, polypropylene, and the like. The fibers are laid out in a mat in random fashion and bonded together at their crossover points by means of an adhesive in the case of natural fibers. The synthetic fibers are thermoplastic and can be bonded together by means of heat. Normal and well known methods can be employed in making the nonwoven fabrics useful herein and one skilled in the art would have no difficulty, since the art is replete with references teaching various methods for making nonwoven fabrics. One excellent nonwoven fabric is one of spunbonded polyester fibers manufactured and sold by E. I. duPont de Nemours & Co. under the trademark Reemay. The nonwoven fabric should not be too thick or too heavy and should have sufficient interstices to allow proper impregnation in the rotomold by the liquid carboxyl-terminated polymer compound. Further, the nonwoven fabric should be preshrunk prior to use in order to prevent the possibility of distortion in the finished product due to shrinkage of the fabric during molding. A satisfactory nonwoven fabric is one having an average weight of about 1 ounce to about 6 ounces per square yard.

The liquid carboxyl-containing polymer composition for making the hollow, rubbery and reinforced bladders or balls of the present invention is one containing (1) an epoxy resin having two or more epoxide groups per molecule on the average; (2) a liquid carboxyl-terminated polymer having from about 1.4 to about 2.6 carboxyl groups per molecule; (3) an amine having selectivity for a carboxyl-epoxide reaction; (4) a dihydric compound; and (5) a plasticizer. In order to obtain the desired flex and tear properties in the finished bladder or ball, the equivalent ratio of components reactive with an epoxy group to epoxy must be from about 0.50 to about 1.15. The rotocasting composition or compound is first prepared in two components with the first component containing the liquid polymer, amine and plasticizers and the second component containing the epoxy and the dihydric compound. The two components are then mixed together at a temperature from about 25° C. to about 100° C. to form the rotocasting composition. The rotocasting operation, as described more fully hereinafter, is carried out at a temperature in the range of from about 100° C. to about 180° C. for a length of time sufficient to cure the composition.

As pointed out above, the liquid carboxyl-containing polymers have an average of about 1.4 to about 2.6 carboxyl groups per polymer molecule. Preferably, the polymer molecule will contain an average of about 1.8 to about 2.2 carboxyl groups. At least one of the carboxyl groups is located at the end of the polymer molecule and preferably both carboxyls are so located so that the polymer is difunctional. The difunctional polymer is then identified as a liquid carboxyl-terminated polymer. The polymers have a carboxyl content of about 1.6% to about 3.4%, based on the weight of the polymer. Preferably, the carboxyl content is in the range from about 2.4% to about 2.8% by weight. The carboxyl content is readily determined by simple titration of a polymer solution.

The liquid carboxyl-containing polymers have a molecular weight of from about 1,000 to about 8,000 and a bulk viscosity of from about 10,000 centipoises to about 600,000 centipoises and preferably from about 30,000 centipoises to about 200,000 centipoises, said bulk viscosity being measured at 27° C. using a Brookfield Model LVT Viscometer with spindle No. 7 at 0.5 to 100 rpm. These polymers are more fully described in U.S. Pat. No. 4,119,592, issued Oct. 10, 1978, which is incorporated herein by reference. As pointed out above, the liquid carboxyl-terminated polymers are preferred. Examples of such polymers are carboxyl-terminated polyethylene, carboxyl-terminated polybutadiene, carboxyl-terminated polyisoprene, carboxyl-terminated poly(-butadiene-acrylonitrile), carboxyl-terminated poly(-butadiene-styrene), carboxyl-terminated poly(butadiene-acrylonitrile-acrylic acid), carboxyl-terminated poly(ethyl acrylate), carboxyl-terminated poly(ethyl acrylate-n-butyl acrylate), carboxyl-terminated poly(n-butyl acrylate-acrylonitrile), carboxyl-terminated poly(butyl acrylate-styrene), and the like. The polymers can be prepared by free-radical polymerization using carboxyl-containing initiators and/or modifiers as disclosed in U.S. Pat. No. 3,285,949, and by solution polymerization using lithium metal or organometallic compounds and posttreating the polymers to form carboxyl groups, as disclosed in U.S. Pat. Nos. 3,135,716 and 3,431,235. The most preferred polymers are the carboxyl-terminated poly(butadiene-acrylonitrile) polymers which contain from about 5% to about 40% of acrylonitrile by weight, about 1.6% to about 3.4% by weight of carboxyl, and about 58% to about 93% by weight of butadiene, based upon the weight of the polymer. The best liquid carboxyl-terminated poly(butadiene-acrylonitrile) polymers for rotocasting rubber balls or bladders for sport balls and play balls are those containing from about 8% to about 20% by weight of acrylonitrile, based on the weight of the polymer.

The epoxy resin used in the liquid polymeric rotocasting composition is one having an average number of epoxide

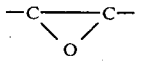

groups per molecule within the range of from about 1.7 to about 3.8. The epoxy resins are liquids having a bulk viscosity of from about 200 centipoises to about 1,000,000 centipoises, and preferably, from about 500 centipoises to about 300,000 centipoises. Examples of the types of epoxy resins that can be employed in the present invention are the diglycidyl ethers of dihydric phenols, the diglycidyl ethers of polyhydric phenol-formaldehydes, the diglycidyl ethers of dihydric aliphatic alcohols, the diglycidyl ethers of cyclo dihydric aliphatic alcohols, the diglycidyl esters of dicarboxylic acids, the diamine compounds substituted by glycidyl radicals, and diepoxidized fatty acids. Examples of each of these types of epoxy resins are shown in U.S. Pat. Nos. 3,655,818 and 3,678,131. The epoxy resins can also be halogenated. The preferred epoxy resins are the diglycidyl ethers of dihydric phenols and the diglycidyl ethers of dihydric aliphatic alcohols. Further, the most preferred epoxy resins have an average of about 2 epoxide groups per molecule. It should be understood that mixtures of the above epoxy resins may also be used.

The amine used in the liquid polymeric rotocasting composition is 2-ethyl-4-methylimidazole. The amount of the amine employed is from about 1 to about 5 parts and preferably, from about 1.5 to about 3 parts by weight, based on 100 parts by weight of the epoxy resin.

The dihydric compound used in the liquid polymeric rotocasting composition is a dihydric aromatic compound. Examples of the dihydric aromatic compounds are catechol, resorcinol, hydroxybenzyl alcohols, bis benzylic alcohol, dihydroxy-naphthalenes, and the like, and bisphenols having the formula

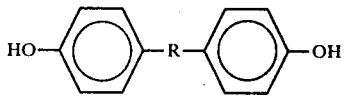

wherein R is an alkylene group containing 1 to 12 carbon atoms or a bivalent radical containing 1 to 8 carbon atoms, and O, S, and/or N. Examples of the bisphenols are methylene bisphenol, butylidene bisphenol, octylidene bisphenol, isopropylidene bisphenol, bisphenol sulfide, bisphenol ether, bisphenol amine, and the like. The amount of dihydric compound employed is from about 5 parts to about 70 parts by weight, based on the weight of 100 parts of epoxy resin and preferably, from about 10 parts to about 45 parts by weight are used. The plasticizers used in the rotocasting composition are those that are well known in the art. Suitable plasticizers for use herein are the petroleum oils, castor oil, glycerine, silicones, aromatic and paraffin oils, and the like; and esters, such as alkyl and aromatic phthalates, sebacates, trimellitates, and the like; and monoepoxides, such as octyl epoxytallate, epoxidized soybean oil, and the like. Preferred plasticizers are di-2-ethylhexyl azelate, 2,2,4-trimethyl-1,3-pentanediol, diisobutyrate, and an aromatic petroleum distillate having a boiling point of 275° C. and sold under the trade name of Kenplast G. The amount of plasticizer used is in the range of about 1 part to about 130 parts by weight and preferably, from about 20 parts to about 50 parts by weight, based on the weight of 100 parts of the epoxy resin.

In order to obtain the desired flex and tear properties of the liquid polymer composition, the equivalent ratio of reactants to epoxy must be from about 0.50 to about 1.15 and preferably from about 0.60 to about 1.10. The reactants are those materials in the composition which react with the epoxy, that is, the carboxyl groups of the liquid polymer, amine groups and the OH groups of the dihydric compound. The equivalent weight of the epoxy resin is determined by dividing the number of epoxide groups per molecule into the molecular weight of the epoxy resin. The equivalent weight of the liquid polymer is determined by dividing the number of carboxyl groups per molecule into the molecular weight of the polymer. The equivalent weight of the dihydric compound is determined by dividing the number of OH groups per molecule into the molecular weight of the dihydric compound. The equivalent weight of 2-ethyl-4-methyl-imidazole is determined by dividing its molecular weight by two. In order to determine the equivalent ratio, the number of equivalents of epoxy used is divided into the sum of equivalents used of the liquid polymer, amine and dihydric compound.

In addition to the essential ingredients, the liquid polymer composition may contain a number of other compounding ingredients which are typically employed in rubber and/or epoxy compounding. The amounts employed are standard and well known in the art. As examples of such compounding ingredients, there may be named carbon black, metal carbonates and silicates, colorants or pigments, metal oxides, antioxidants, stabilizers, and the like. The only limitation placed on the amounts of said compounding ingredients is that the liquid polymer composition containing these ingredients must be rotocastable at temperatures in the range of from about 100° C. to about 180° C. and the viscosity of the liquid polymer composition must be less than about 2,500 centipoises measured at 75° C. This relatively low viscosity is needed in order to rotocast articles with thin walls of 50 mils or less.

As has been pointed out above, the half shells of preshrunk nonwoven reinforcing fabric are sealed together by placing between the two layers thereof, in the flange area, or in between the overlapping portions of the nonwoven fabric, a film formed from an amine-terminated liquid polymer so that the heat of molding, or rotocasting, causes said film to melt and flow and adhere the two sections of fabric tightly together. The amine-terminated liquid polymers useful for making said adhesive seal are those prepared by reacting a carboxyl-terminated, ester-terminated, or acid chloride-terminated liquid polymer having a carbon-carbon backbone with at least one aliphatic, alicyclic, heterocyclic, or aromatic amine containing at least two secondary or mixed primary/secondary amine groups, but no more than one primary amine group per molecule. These amine-terminated liquid polymers are shown and described in U.S. Pat. No. 4,133,957, issued Jan. 9, 1979 and incorporated herein by reference.

The amine-terminated liquid polymers can be produced containing substantially fewer by-products than the mixed products of the prior art, provided that amines used in preparing the same contain no more than one primary amine group per amine molecule. The amine-terminated liquid polymers referred to are those having the formula $$Y-\overset{\overset{\displaystyle O}{\|}}{C}+B+\overset{\overset{\displaystyle O}{\|}}{C}-Y$$

wherein Y is a univalent radical obtained by removing a hydrogen from an amine group of an aliphatic, alicyclic, heterocyclic or aromatic amine containing at least two secondary or mixed primary/secondary amine groups, but no more than one primary amine group per molecule. B is a polymeric backbone comprising carbon-carbon linkages. Generally the carbon-carbon linkages comprise at least about 95% by weight of total polymeric backbone weight, and preferably, about 100% by weight of total polymeric backbone weight. The amine-terminated liquid polymers contain an average of from about 1.5 to about 4 primary and/or secondary amine groups per molecule, and preferably, from about 1.7 to about 3 primary and/or secondary amine groups per molecule. The said liquid polymers have Brookfield viscosities (measured using a Brookfield RVT viscometer at 27° C.) from about 500 centipoises to about 2,500,000 centipoises, and preferably, from about 500 centipoises to about 1,200,000 centipoises. The amine-terminated liquid polymers may have amine equivalent weights (gram molecular weight per primary and/or secondary amine group, but exclusive of tertiary amine groups) from about 300 to about 4,000 and preferably, from about 600 to about 3,000.

The amines which react well with the carboxyl-terminated, ester-terminated, and acid chloride-terminated polymers, mentioned above, include aliphatic amines containing from two to 20 carbon atoms, more preferably from 2 to 12 carbon atoms, and at least two, and preferably two secondary amine groups or mixed primary/secondary amine groups, but no more than one primary amine group per molecule. Also suitable are alicyclic amines containing from 4 to 20 carbon atoms, and preferably, from 4 to 12 carbon atoms, and at least two, preferably two, secondary amine groups or mixed primary/secondary amine groups, but no more than one primary amine group per molecule. Heterocyclic amines may also be used which contain from 2 to 20 carbon atoms, and preferably from 2 to 12 carbon atoms, and at least two, and preferably two, secondary amine groups or mixed primary/secondary amine groups, but no more than one primary amine group per molecule. Also suitable are aromatic amines containing from 7 to 20 carbon atoms, and preferably from 7 to 14 carbon atoms, and at least two, and preferably two, secondary amine groups or mixed primary/secondary amine groups, but no more than one primary amine group per molecule. As examples of the amines described herein there may be named N-methyl-1,3-propanediamine, 3,amino-1,2,4-triazole,4,4'-trimethylenedipiperidine, 4-(aminomethyl)piperidine, piperazine, N-(aminoalkyl)piperazines wherein the alkyl group contains from 1 to 12 carbon atoms, such as N-(2-aminoethyl) piperazine, N-(3-aminopropyl)piperazine, and the like, N-phenyl-O-phenylenediamine, N-phenylethylenediamine, etc. Numerous other amines will be apparent to those skilled in the art.

The amine-terminated liquid polymer can be formed into a thin film by any of the usual procedures well known in the art. For example, one convenient method is to pass or extrude the polymer through an elongated slot onto a moving continuous belt, usually made of stainless steel. The belt is enclosed in a heated atmosphere, the temperature being maintained sufficiently high to set the polymer in the form of a film. The temperature will vary depending upon the particular polymer being extruded, or cast, in the form of a film. Usually a temperature in the range of about 80° C. to about 120° C. is satisfactory. After the film is made, rings are cut or stamped therefrom of such size as to fit the flange of the particular rotocasting mold being employed. In the case of the overlapping portions of fabric, a thin strip is cut for placing therebetween. The thickness of the film can be varied but generally, a thickness in the range of about 2 mils to about 40 mils is satisfactory. It is preferred, however, to employ a film thickness in the range of about 5 mils to about 15 mils.

The rotocasting composition, containing the liquid carboxyl-terminated polymer, the epoxy, the amine, the dihydric compound, and the plasticizer, is first prepared as two separate liquid components. The first component contains the liquid carboxyl-terminated polymer, the amine and the plasticizer. The second component contains the epoxy and the dihydric compound. The materials in each component are mixed separately using an appropriate apparatus, such as a mixing kettle, Henschel mixer, ink mill, and the like, while employing standard mixing procedures, using heat when appropriate to obtain proper dissolution and uniform dispersion of materials. Thereafter, the two components are mixed together at a temperature of from about 25° C. to about 100° C. The viscosity of the resulting rotocasting composition should be less than about 2,500 centipoises at 75° C. in order to be rotocast, in accordance with the present invention. In this way, the desired thin reinforced walls of 50 mils, or less, can be obtained. It should be pointed out that the rotocasting composition is maintained at said temperature until ready for use.

In the next step, the nonwoven preshrunk reinforcing fabric is precut and inserted in the two halves of the rotocasting mold in such a manner as to cover the inner wall and the flange surfaces or so as to overlap. The film strip of the amine-terminated liquid polymer is placed between the two layers of nonwoven fabric in the flange or overlapping area. When making a bladder for a ball that is to be pumped up, such as a basketball, football, and the like, a pneumatic valve housing is placed on a pin in the rotocast mold. In such a situation, the nonwoven fabric in that half of the mold will have an opening therein to accomodate said housing. Before clamping or fastening the two halves of the mold together, the rotocasting composition is injected or poured into the lower half of the mold. The mold is then heated, while being rotated, to a temperature in the range of about 110° C. to about 180° C. and preferably, in the range of about 150° C. to about 170° C. The rotocasting composition in the mold will remain liquid, or substantially unchanged for about the first 3 to 7 minutes of the rotation at said temperatures. This is sufficient time for the composition to penetrate or impregnate the nonwoven fabric and produce a uniform layer over the entire rotocasting mold surface before the composition begins to cure and set. The time for curing to begin is influenced, or predetermined by, the amount of amine in the rotocasting composition.

When the mold is heated to the temperature indicated above, the film strip in the flange or overlapping area melts and becomes an amine-terminated liquid polymer adhesive. As the heating continues, said polymer adhesive is cured, or set, and binds the two halves, or sections, of nonwoven fabric together.

Typically, in a rotational molding process, the mold is rotated about two axis simultaneously. That is, there is a major and a minor axis and the ratio of speed about the major and minor axis is chosen so as to match the shape of the mold being employed. The heated mold is rotated for a time sufficient to completely cure the rotocasting composition, which is from about 10 minutes to about 40 minutes. The curing time is dependent upon the mold temperature and the selection of ingredients in the composition. Once the composition has been cured, the mold is cooled and the cured rubbery reinforced bladder or ball is removed from the mold. When a valve housing has been employed in making a bladder, a check valve assembly is then inserted into the valve housing.

To further define the present invention, the following specific example is given, it being understood that this is merely intended in an illustrative and not a limitative sense. In the example, all parts and percents are by weight unless otherwise indicated.

EXAMPLE I

In order to form the rotocasting polymer compound or rubber, the following recipes were employed:

| Component A | |
|---|---|
| Carboxyl-terminated poly(butadiene-acrylonitrile) rubber (10% acrylonitrile | 42.0 pts. |
| 2,2,4-trimethyl-1,3-pentanediol diisobutyrate | 10.5 pts. |
| Dioctylated diphenylamine mixture | 1.0 pt. |
| 2-ethyl-4-methylimidazole | 0.7 pt. |
| Carbon black (50% dispersion in dioctyl phthalate) | 1.0 pt. |
| Silicone oil surfactant (DC-200) made by Dow Corning | 0.3 pt. |

| Component(B) | |
|---|---|
| Diglycidyl ether of bisphenol A | 32.7 pts. |
| p,p'-isopropylidene bisphenol | 13.1 pts. |

Component (A) was dissolved by heating at 75° C. for 30 minutes with stirring. Component (B) was dissolved by heating at 105°-110° C. for 30 minutes. Just prior to use, component (B) was added to component (A) at 75° C. and stirred for 2 to 4 minutes. During stirring, a vacuum was used to remove entrapped air. Thereafter, the resulting solution was cooled to room temperature with a water bath.

The amine terminated liquid polymer composition used in making the adhesive film strip was made as follows:

| | |
|---|---|
| Amine terminated poly(butadiene-acrylonitrile) rubber (10% acrylonitrile) | 216 pts. |
| 3,4-epoxycyclohexylmethyl-3,4-epoxycyclohexane carboxylate | 100 pts. |
| Hexahydropthalic anhydride | 79 pts. |

The above ingredients were prepheated to 120° C. and then mixed for 7 minutes with no additional heating. The mixture was then poured into a large flat open metal pan and allowed to cool, thus forming a thin sheet or film which was easily removable from the pan.

A sheet of spun bonded polyester nonwoven fabric was formed into half shells by drawing the sheet over a 4 inch diameter spherical aluminum half shell form and heated at 350°-400° F. for 15-30 minutes in order to preshrink the fabric. One half shell was placed in the lower half of the mold in such a manner as to overlap the flange area and a strip of film made from component (C) above was placed over the fabric in the flange area. Then the other half shell of fabric was placed in the upper half of the mold so as to overlap the flange area. The molding solution of components (A) and (B) was poured into the lower half of the mold and the mold sealed by clamping the two halves together at the flange area. The strip of film between the two nonwoven fabrics in the flange area had a width of 0.625 inch. Thereafter the mold was rotated about 2 axes, the ratio of rotation of the major to minor axis being 8:3. Rotation of the mold was at an internal temperature of 350° F. for a period of 20 minutes after which the mold was cooled down to room temperature in about 2 minutes. During the rotocasting procedure, the film between the sections of non-woven shells was melted and cured forming a tight seal or bond therebetween. There was good penetration of the nonwoven fabric by the molding solution forming a smooth reinforced film producing an excellent ball. The outer edge of the flange area was trimmed off with a knife. Of course, in production, a pair of rotary knife blades could be employed to remove the protruding edge of the flange area.

Using the same components as above, two further balls were made in the same manner except that one ball was made using non-preshrunk nonwoven fabric. The second ball was made using the preshrunk nonwoven fabric but the same was placed in the half shells of the mold in overlapping relationship with a film strip of component (C) therebetween. Both balls made with the reinforcing nonwoven fabric were more uniform in size and shape and were stronger than a ball made in conventional manner without the use of the nonwoven fabric. However, in the case of the non-preshrunk nonwoven fabric there was a tendency for the fabric to shrink in diameter away from the wall of the ball. This illustrates the desirability of using a preshrunk nonwoven fabric.

The present invention has many advantages chief among which is the built in dimentional stability of the product. This is particularly true in the case of pneumatic or inflated sport balls. The use of nonwoven fabric, in accordance with the present invention, eliminates the complicated filament winding process presently used which requires computerized controls for uniformity of distribution. Further, the winding operation is a separate step whereas, with the present invention, there is provided a one step process for bladder or ball preparation and fiber reinforcement which is an obvious economic advantage. Also the strength and tear resistance of the bladder or ball is significantly improved. Other advantages will be apparent to those skilled in the art.

While the present invention has been described in terms of its specific embodiments, certain modifications and equivalents will be apparent to those skilled in the art and are intended to be included within the scope of the present invention, which is to be limited only by the scope of the appended claims.

I claim:

1. A process for making reinforced rubbery sport balls and play balls by rotational casting comprising placing in the two halves of a rotary mold two preshrunk and preformed half shells of nonwoven fabric in such a manner as to line the entire inner surface, said shells being of such size as to provide sufficient area at the edge thereof to bind one nonwoven shell to the other, placing in the lower half of the mold a liquid polymer rotocasting composition containing an epoxy resin, a liquid carboxyl-terminated polymer, an amine, a dihydric compound, and a plasticizer, said composition having a viscosity of less than 2500 centipoises at 75° C., placing between said shells in the area at the edge thereof a strip of film made from an amine-terminated liquid polymer, fastening the two halves of the mold together, heating the mold while being rotated to a temperature in the range of about 110° C. to about 180° C., said mold being rotated about a major axis and a minor axis simultaneously for a time sufficient to completely cure said rotocasting composition whereby the heat of rotocasting melts said strip of film to a polymeric adhesive and cures and sets the same binding said shells together, and thereafter cooling said mold and removing the ball therefrom.

2. A process as defined in claim 1 wherein the amine-terminated liquid polymer has the formula $$Y-\overset{\overset{\displaystyle O}{\|}}{C}+B+\overset{\overset{\displaystyle O}{\|}}{C}-Y$$

wherein Y is a univalent radical obtained by removing a hydrogen from an amine group of an aliphatic alicyclic, heterocyclic or aromatic amine, containing from 2 to 20 carbon atoms and at least two secondary or mixed primary/secondary amine groups per amine molecule, but no more than one primary amine group per amine molecule, and B is a polymeric backbone containing carbon-carbon linkages comprising a least 95% of the total polymeric backbone weight, said backbone B containing polymerized units of at least one polymerizable olefinic monomer having at least one terminal $CH_2{=}C{<}$group.

3. A process as defined in claim 1 wherein the curing time for said rotocasting composition in the mold is in the range of about 10 minutes to about 40 minutes.

4. A process as defined in claim 1 wherein the strip of film made from the amine-terminated liquid polymer has a thickness in the range of about 2 mils to about 40 mils.

5. A process as defined in claim 1 wherein the nonwoven fabric has a weight of about 1 ounce to about 6 ounces per square yard.

6. A process as defined in claim 1 wherein the thickness of the finished rubbery ball is about 50 mils or less.

7. A process as defined in claim 1 wherein the half shells of nonwoven fabric are overlapped in the mold with said film strip therebetween.

8. A process as defined in claim 1 wherein the half shells of nonwoven fabric overlap the mold flange area with the film strip therebetween on the flange.

9. A process as defined in claim 1 wherein a valve housing is positioned in the mold prior to making the ball and a check valve assembly is inserted in said housing after removal of the ball from the mold.

10. A process as defined in claim 1 wherein the liquid polymer rotocasting composition is comprised of a. a liquid carboxyl-terminated polymer containing polymerized units of a vinylidene monomer, said polymer having from about 1.4 to about 2.6 carboxyl groups per molecule, b. an epoxy resin having an average number of epoxide groups per molecule of from about 1.7 to about 2.3, c. a plasticizer, d. a dyhydric compound selected from the group consisting of catechol, resorcinol, hydroxybenzyl alcohol, dihydroxy naphthalene, and bisphenols of the formula

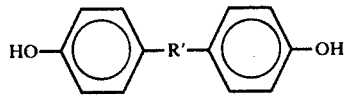

wherein R' is selected from the group consisting of an alkylene group containing from 1 to 12 carbon atoms and a bivalent radical containing from 1 to 8 carbon atoms, and O, S, and/or N, and e. 2-ethyl-4-methylimidazole, and wherein the equivalent ratio of the sum of reactants a, d, and e, to epoxy resin is from about 0.70 to about 1.15.

11. A process as defined in claim 10 wherein the amine-terminated liquid polymer has the formula

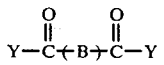

wherein Y is a univalent radical obtained by removing a hydrogen from an amine group of an aliphatic, alicyclic, heterocyclic or aromatic amine containing from 2 to 20 carbon atoms and at least two secondary or mixed primary/secondary amine groups per amine molecule but no more than one primary amine group per amine molecule, and B is a polymeric backbone containing carbon-carbon linkages comprising at least 95% of the total polymeric backbone weight, said backbone B containing polymerized units of at least one polymerizable olefinic monomer having at least one terminal $CH_2{=}C{<}$ group.

12. A process as defined in claim 11 wherein the nonwoven fabric has a weight of about 1 ounce to about 6 ounces per square yard and wherein the strip of film made from the amine-terminated liquid polymer has a thickness in the range of about 5 mils to about 15 mils.

13. A process as defined in claim 12 wherein the curing time for said rotocasting composition in the mold is in the range of about 10 minutes to about 40 minutes and wherein the thickness of the finished rubbery ball is about 50 mils or less.

14. A process as defined in claim 13 wherein the half shells of nonwoven fabric are overlapped in the mold with said film strip therebetween.

15. A process as defined in claim 13 wherein the half shells of nonwoven fabric overlap the mold flange area with the film strip therebetween on the flange.

16. The product produced by the process of claim 1.

17. The product produced by the process of claim 2.

18. The product produced by the process of claim 9.

19. The product produced by the process of claim 10.

20. The product produced by the process of claim 14.

21. The product produced by the process of claim 15.

* * * * *